US007757889B1

(12) United States Patent
Zipris et al.

(10) Patent No.: US 7,757,889 B1
(45) Date of Patent: Jul. 20, 2010

(54) SEALING AND REOPENING DEVICE FOR OPENED ALUMINUM BEVERAGE CANS

(76) Inventors: Zeev Haim Zipris, 500 Bayview Dr., Sunny Isle Beach, FL (US) 33160; Ouri Azriel Neuman, 22 Byvangen, Slangerup (DK) 3550

( * ) Notice: Subject to any disclaimer, the term of this patent is extended or adjusted under 35 U.S.C. 154(b) by 0 days.

(21) Appl. No.: 11/532,711

(22) Filed: Sep. 18, 2006

Related U.S. Application Data

(60) Provisional application No. 60/721,003, filed on Sep. 27, 2005.

(51) Int. Cl.
*B65D 39/00* (2006.01)

(52) U.S. Cl. ..... 220/789

(58) Field of Classification Search ..... 220/906, 220/780, 794, 234, 233, 796, 801, FOR. 109, 220/FOR. 105, DIG. 19; 215/902, 358, 247, 215/248, 270, 260, 269, 305, 295, 200; D9/443, D9/439, 435; *B65D 55/12, 39/12*
See application file for complete search history.

(56) References Cited

U.S. PATENT DOCUMENTS

| | | | | | |
|---|---|---|---|---|---|
| 217,489 | A | * | 7/1879 | Scantlin et al. | 222/183 |
| 907,875 | A | * | 12/1908 | Pritchard | 4/259 |
| 1,120,369 | A | * | 12/1914 | Booraem et al. | 411/15 |
| 1,452,039 | A | * | 4/1923 | Gravell | 217/3 CB |
| 1,675,006 | A | * | 6/1928 | Thomas | 215/358 |
| 2,224,296 | A | * | 12/1940 | Hoffman | 215/260 |
| 2,228,936 | A | * | 1/1941 | Walter | 215/262 |
| 2,365,598 | A | * | 12/1944 | Rubin | 215/355 |
| 2,367,883 | A | * | 1/1945 | Miller | 215/270 |
| 2,755,952 | A | * | 7/1956 | Ringen | 222/490 |
| 2,841,166 | A | * | 7/1958 | Auzin | 137/223 |
| 2,848,130 | A | * | 8/1958 | Jesnig | 215/45 |
| 3,121,310 | A | * | 2/1964 | Rice | 60/770 |
| 3,168,961 | A | * | 2/1965 | Yates | 220/787 |
| 3,424,338 | A | | 1/1969 | Kazel | |
| 3,744,662 | A | | 7/1973 | Zundel | |
| 3,807,595 | A | | 4/1974 | Zundel | |

(Continued)

FOREIGN PATENT DOCUMENTS

| | | |
|---|---|---|
| DE | 4335709 | 3/1994 |

(Continued)

OTHER PUBLICATIONS

Horton, Brendan. "Keeping Growth Under Control". Nature. London, Sep. 4, 1997, vol. 389, Iss. 6646, pp. 101-102.*

*Primary Examiner*—Anthony Stashick
*Assistant Examiner*—Robert J Hicks
(74) *Attorney, Agent, or Firm*—Rick Martin; Patent Law Offices of Rick Martin, P.C.

(57) ABSTRACT

Aluminum pop-top can holes are re-sealed with several embodiments of plugs or tape. The wedge type is shoved into the teardrop can hole, or any other shaped can hole. The foot (shoulder) profile type has a triple sealing surface, whereby the user angles a foot or shoulder of a plug under the can lid. These types can be massive or hollow. The hollow type can have a mini double-acting valve for pumping function. A flexible (plastic) tape and glue version is shown, useful also as a primary sealing means.

3 Claims, 7 Drawing Sheets

U.S. PATENT DOCUMENTS 3,904,071 A 9/1975 Stearns
3,945,529 A * 3/1976 Haag ..... 220/254.1
4,232,797 A 11/1980 Waterbury
4,234,099 A 11/1980 Tarro
4,393,979 A 7/1983 Ball et al.
4,433,792 A 2/1984 Mandel
4,463,866 A 8/1984 Mandel
4,526,287 A 7/1985 Miyamatsu et al.
4,544,074 A * 10/1985 Evans ..... 215/355
4,681,238 A 7/1987 Sanchez
4,703,873 A 11/1987 Geren
4,809,871 A * 3/1989 Angelchik ..... 220/789
4,877,129 A 10/1989 Wells
4,880,137 A 11/1989 Wells
4,887,712 A 12/1989 Wells
4,930,654 A 6/1990 Thibeault et al.
4,991,732 A 2/1991 LaBarge et al.
5,108,003 A 4/1992 Granofsky
5,139,163 A 8/1992 Diaz
5,199,591 A 4/1993 Thibeault et al.
5,242,073 A 9/1993 Willis et al.
5,452,818 A 9/1995 Yost
5,617,970 A * 4/1997 Lee ..... 220/730
5,632,440 A 5/1997 Tragardh et al.
5,705,209 A * 1/1998 Wright et al. ..... 426/112
5,984,127 A 11/1999 Fenton
6,098,830 A 8/2000 Jamieson
6,227,392 B1 * 5/2001 Balzeau ..... 215/364
6,321,927 B2 * 11/2001 Cavella ..... 220/359.2
6,398,050 B1 * 6/2002 Allora ..... 215/228
6,443,323 B1 9/2002 DeRose
6,575,324 B1 6/2003 Hamer
6,619,493 B2 * 9/2003 Yang ..... 215/228
6,626,314 B1 9/2003 McHenry et al.
6,763,964 B1 * 7/2004 Hurlbut et al. ..... 220/254.3
6,789,690 B2 * 9/2004 Nieh et al. ..... 220/231
6,793,087 B2 9/2004 Dyren
6,837,392 B2 1/2005 Laurent
2002/0030053 A1 3/2002 Copeland
2002/0088802 A1 7/2002 DeRose
2003/0003023 A1 * 1/2003 Korpela ..... 422/99
2004/0013827 A1 1/2004 Zuser et al.
2004/0065664 A1 4/2004 Steadman
2004/0188440 A1 9/2004 Schlattl et al.
2004/0256346 A1 12/2004 Becker et al.
2004/0256386 A1 12/2004 LaFortune
2004/0262337 A1 * 12/2004 Young ..... 222/484
2007/0023442 A1 * 2/2007 Auzenne ..... 220/801

FOREIGN PATENT DOCUMENTS

FR 2622871 A1 * 5/1989
FR 2684964 A1 * 6/1993
GB 2305657 4/1997
WO WO 8201535 A1 * 5/1982
WO WO 9006266 A1 * 6/1990

* cited by examiner

SEALING AND REOPENING DEVICE FOR OPENED ALUMINUM BEVERAGE CANS

CROSS REFERENCE APPLICATIONS

This application is a non-provisional application claiming the benefits of provisional application No. 60/721,003 filed Sep. 27, 2005.

FIELD OF INVENTION

The present invention relates to sealing and then reopening aluminum beverage cans.

BACKGROUND OF THE INVENTION

Historically many inventors have addressed the problem of saving the beverage contents of a partially consumed can of soda or beer. U.S. Pat. No. 3,904,071 (1975) to Stearns discloses a seal for an opening in a flip-top can, where it is desired to re-close the can after a portion of the contents has been removed. A cover (20, FIGS. 7,8) has a wire frame with an elastic (rubber bag) upper portion shaped like the oval opening and supporting a handle. Under the upper portion is a lower portion sized larger than the opening. The handle is used to wedge the upper and lower portions into the hole. Design flaws would appear to be the tendency of a rubber bag to wear and tear against the sharp edges of a hole in the aluminum can. It could not be used in all shapes of holes; it is expensive in production. Also a relatively great force is required to put it into place making it inconvenient for women and children.

U.S. Pat. No. 4,433,792 (1984) to Mandel discloses a tab pivotally mounted to a pivot rivet located next to the hole. The underside of the tab has a plastic coated lip, which is used to reseal the opening. This invention requires a custom-made aluminum can.

Pub. No. US 2004/0013827 A1 (2004) to Zuser et al. discloses a thermally sealable multilayer film for a custom can re-sealable opening. This invention requires custom-made plastic containers.

A brief summary of other related art follows below.

D.E. 04335709 discloses a swivel pull tab on a can such that for re-sealing after the pull tab is cracked open, a plug on the bottom of the pull tab can be pushed back into the hole.

G.B. 2305657 discloses a similar concept to DE04335709 along with a PCT search report negating its patentability.

U.S. Pat. No. 3,424,338 (1969) to Kazel discloses a re-sealable can with a hole covered by a tear strip having a plug.

U.S. Pat. No. 3,744,662 (1973) to Zundel (see also 3,807,5950) discloses a similar concept to '792, but the Examiner of '792 did not cite this reference. Two holes are re-sealed with tab plugs.

U.S. Pat. No. 3,904,071 (1975) to Stearns discloses a foot type re-sealer on a flip top can. A wire frame holds a flexible cover that is inserted down into the teardrop shaped hole, then pulled up via a handle T. seal. It is expensive to produce and needs a big force to operate.

U.S. Pat. No. 4,232,797 (1980) to Waterburg discloses a can top design with a plastic hinged flap to re-seal a hole.

U.S. Pat. No. 4,234,099 (1980) to Tarro discloses a similar concept T. Mandel's 1984 invention.

U.S. Pat. No. 4,393,979 (1983) to Ball et al. discloses a foot type closure.

U.S. Pat. No. 4,526,287 (1985) to Miyamatsu et al. discloses a flexible, plastic tab covering a hole in a can via thermoplastic resin.

U.S. Pat. No. 4,463,866 (1984) to Mandel discloses a re-sealable pop-top can with a stopper on the tab.

U.S. Pat. No. 4,681,238 (1987) to Sanchez discloses a rotatable, re-sealable pop-top can with a stopper on the tab.

U.S. Pat. No. 4,703,873 (1987) to Geren discloses a reusable lid.

U.S. Pat. No. 4,877,129 (1989) to Wells (and U.S. Pat. Nos. 4,880,137 and 4,887,712) discloses a re-sealable stopper 57, FIG. 10A and re-closure cover 158, FIG. 16A.

U.S. Pat. No. 4,930,654 (1990) to Thibeault et al. discloses a re-sealable pop-top can.

U.S. Pat. No. 4,991,732 (1991) to La Barge et al. discloses an automatic venting cap.

U.S. Pat. No. 5,108,003 (1992) to Granofsky discloses peel back cover with a stopper as a can top for re-sealable use.

U.S. Pat. No. 5,139,163 (1992) to Diaz discloses a re-sealable lid.

U.S. Pat. No. 5,199,591 (1993) to Thibeault et al. discloses another re-sealable tab on a pop-top can.

U.S. Pat. No. 5,242,073 (1993) to Willis et al. (Alcoa) discloses a rotatable stopper for a round hole in a can.

U.S. Pat. No. 5,452,818 (1995) to Yost discloses a resealing lid.

U.S. Pat. No. 5,632,440 (1997) to Tragardh et al. discloses a plug in closure.

What is needed is a plug means functioning to reseal any standard aluminum can opening. The invention is universal to all hole shapes and sizes in the can lid of all existing cans on the market and is independent of all existing production, filling and sale of aluminum beverage cans. Several embodiments are disclosed herein, which seal multiple times an opened aluminum beverage can. Another embodiment discloses using a custom designed can.

SUMMARY OF THE INVENTION

An aspect of the present invention is to provide a seal for any existing shaped hole, a wedge shaped plug for any standard, already opened aluminum beverage can.

Another aspect of the present invention is to provide a seal for any existing shaped hole, an insertable foot (shoulder) plug for any standard already opened aluminum beverage can.

Another aspect of the present invention is to provide a sealing tape (foil) sealing and reopening device for a standard aluminum beverage can.

Other aspects of this invention will appear from the following description and appended claims, reference being made to the accompanying drawings forming a part of this specification wherein like reference characters designate corresponding parts in the several views.

The invention concerns a sealing and reopening device for sealing of "already opened" aluminum beverage cans (containers).

The unique points and advantages of this invention include:

1. The present invention does not require any changes in the existing tools and/or machinery for the existing designs of or production of all the existing aluminum beverage cans, nor at the existing beverage filling-plants.
2. By choice, it could be marketed and sold either in connection with the sale of aluminum beverage cans, or completely independent of it.
3. It could be easily produced to fit any shape of existing holes or future holes in the lids of the entire existing and/or future aluminum beverage cans.

4. Thus it requires no unnecessary investments in tools and/or machinery at the can/beverage manufacturers' plants.
5. It is easy and cheap to produce this invention in automatic serial and/or mass production.
6. It can be easily and simply used by all persons including women and children.
7. Perhaps the prior art with the same purpose and goal, were not adopted by the can and/or beverage companies because:
   a. They require big new investments in existing tools and/or machinery.
   b. Introducing a sealing and reopening device for aluminum cans may reduce the sales volume of cans and beverages.
8. Most of the prior art inventions for resealing aluminum beverage cans were a part of the can, and therefore, depended on the decision, will and interests of the can and/or beverage manufacturers. The present invention is completely independent of the decision, will and interests of the can and/or beverage manufacturers, but serves only and completely the wishes and interests of the END-USER.

At present, with glass and/or plastic bottles (containers) for beverage, one can reseal the bottles (containers) after they have been already opened for the first time. This prevents the spilling of the liquid contents (especially in movement). This also prevents the CO2 gas in the liquid contents from escaping with time, thus preventing making the liquid contents taste flat and/or dull. These advantages allow the end-user to drink the liquid contents over a longer period of time, without spilling and/or loosing the original taste or throwing away the unused good product in the bottle.

This is not the case with "already opened" aluminum beverage cans. These pop-top cans force the end-user of the aluminum beverage cans to empty the contents of the beverage cans within a relatively short period of time or throw away the unused good product. This waste occurs in order to prevent spilling in movement and/or losing the original taste of the liquid contents of the can, which is not always to the advantage and/or convenience of the end-user.

In order to bring the aluminum beverage cans to the same "level of convenience" as that of glass and/or plastic bottles (containers), comes this invention of a sealing and reopening device for "already opened" aluminum beverage cans.

The approach of the invention is that the sealing and reopening device should be such, that it can easily close the hole in any standard aluminum-can lid, can be reopened easily again, and that this operation can be repeated a multiple number of times, at the will and convenience of the can end-user, until the can is emptied of its contents.

The present patent invention covers two different principle kinds of approaches, namely, a) The "plug system" approach, b) The "tape system" and/or "foil system" approach. The choice of which approach to choose would depend on the decision of the beverage and/or the can manufacturers on the one side but also the can users (end-users) on the other side.

The choice of which approach to adopt, which could differ from one beverage manufacturer/can manufacturer to another, will depend on marketing, economical, technical, storage, hygienic and esthetic problems and view points, as well as the willingness of making possible minor changes in the aluminum can lid.

The beverage manufacturers will also have to decide how to sell/distribute the sealing and reopening device to the end-users, for their own cans. For example they could attach it to each can, and/or package it loosely in a plastic bag attached to a package of cans, and/or distribute it freely and at will at the selling-point to the end-user, and/or sell it by the seller of the beverage cans, in connection with the sale of a beverage can(s), and/or sell it completely separately from the sale of beverage cans by an independent supplier, and/or any other possible distribution/sale outlet for the sealing and reopening device.

Furthermore, to illustrate the two possible kinds of principle approaches mentioned above (plug/tape/foil systems), seven possible principle solutions, are disclosed in order to describe what is meant by the "sealing and reopening device". Each solution can be made and produced simply, effectively, and economically.

Embodiment one shows a wedge formed aluminum-can sealing and reopening device made of massive soft rubber or soft plastic or soft foamed material. It is important that the material used is non-toxic. The drawing shows a cross-section of the sealing and reopening device, while the upper or top view of the sealing and reopening device will coincide with, and follow the shape and the contour of the hole it is targeted to seal, such as a teardrop or other shape of the hole.

By pressing with the fingers on the head/grip of the sealing and reopening device, one could easily insert it into the hole in the can lid, deep enough, and when releasing the fingers' pressure on the head/grip, it will hold itself in the hole, and create a pressure against the edge of the hole, thus sealing it. By pressing again with the fingers on the head/grip, one could easily release the sealing and reopening device from the hole, thus opening again the aluminum beverage can for drinking.

Such a solution could be used, with advantage, for cans that contain non-gaseous beverage liquids.

Embodiment two shows a wedge formed alu-can sealing and reopening device, similar to the one described in embodiment one, except that this sealing and reopening device is hollow and not massive. The advantage of such a solution is that it will be easier to press it into and/or release it out of the hole in the can lid. In the top of the head/grip a "breathing hole" (BH) is optional for allowing the air to get out of and come back into the "hollow", thus making it even easier to press-in the hollow wedge formed alu-can sealing and reopening device, when putting the device into and taking it out of the open hole in the alu-can lid, and thus also requiring a smaller fingers-force for the operation of sealing and reopening the already opened hole in the beverage-aluminum-cans.

Furthermore one could (by choice and if necessary) add to the head/grip of the sealing and reopening device, a simple "hold and release" double-acting air-valve, in order to pump air into and/or release air out of the "hollow" of the sealing and reopening device, in order to assure better sealing on the one side and/or to help releasing the sealing and reopening device for opening the can, on the other side.

Embodiment three shows a foot (shoulder) style profile shaped aluminum-can sealing- and reopening-device made of massive soft rubber or soft plastic or soft foamed material. It is important that the material used is non-toxic. The drawing shows a cross-section of the sealing and reopening device, while the upper or top view of the sealing and reopening device will coincide with, and follow the shape and the contour of the hole it is targeted to seal, such as a teardrop or other shaped hole.

By pressing with the fingers on the head/grip of the sealing and reopening device, one could easily insert it into the hole, making the can lid slide into the neck of the sealing and reopening device between the head/grip and the shoulder thus creating a triple sealing area, namely, a) outside the can lid and around the hole, b) at the edge of the hole in the can lid and around the hole, c) inside the can lid and around the hole.

By pressing again with the fingers on the head/grip, one could easily release the sealing and reopening device from the hole and open the can.

Such a solution could be used, with advantage, for cans that contain gaseous beverage liquids.

Embodiment four shows a profile shaped aluminum-can sealing and reopening device, similar to the one described in embodiment three, except that this sealing and reopening device is hollow and not massive. The advantage of such a solution is that it will be easier to press it into and fit it into the hole in the can lid that it is targeted to seal. One should also consider optionally making in the top of the head/grip a "breathing hole" (BH) for allowing air to get out of and come back into the "hollow", thus making it even easier to press-in the hollow profile shaped alu-can sealing and reopening device, when putting the device into and taking it out of the open hole in the alu-can lid, and thus also requiring a smaller fingers-force for the operation of sealing and reopening the already opened hole in the beverage-aluminum-can.

Furthermore, one could, by choice, add to the "head/grip" of the sealing and reopening device, a simple "hold and release" double-acting air-valve in order to pump air into and/or out of the "hollow" of the sealing and reopening device to assure better sealing of the can on the one side, and to help releasing the sealing and reopening device from the hole for opening the can, on the other side.

It will be an advantage for the sealing and reopening devices mentioned above that the can manufacturers could make the little handle, which is used, at present, for opening the hole in the lid of the can, to be broken off more easily, after bending it several times with the fingers forward and backwards.

Embodiment five shows a tape and/or aluminum foil type aluminum-can sealing and reopening device. The tape/aluminum foil could be made of rubber or plastic or similar material or aluminum foil, and should be of such strength and thickness that it would be able to withstand, without cracking and/or breaking, the pressure existing in aluminum cans with gaseous beverage liquids. It is important that the material used for the tape/foil is non-toxic.

The adhesive glue should also be: a) of non-toxic type, b) could withstand the pressure existing in the aluminum cans with the gaseous beverage liquids, c) could be opened and sealed multiple times without loosing its sealing and/or adhesive characteristics.

The top or upper view of the tape/foil sealing and reopening device will coincide with and follow the shape and the contour of the hole it is targeted to seal.

The tape/foil could, with advantage, have a "tongue" or tab at one end of the sealing and reopening device, without glue, which could serve as a "handle" for opening/closing/sealing the hole of the aluminum can.

When one chooses to use the tape/foil sealing and reopening device approach for sealing the "already opened" aluminum cans, one could also consider using it as both a primary & secondary sealer for the aluminum beverage cans. This would, of course, require making relevant changes in the construction and shape of the lid of the beverage aluminum cans.

All the drawings are principle drawings only not necessarily drawn to scale. Each embodiment would follow the shape and contour of the hole it is targeted to seal, in a top view.

Before explaining the disclosed embodiments of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

Figure 1:
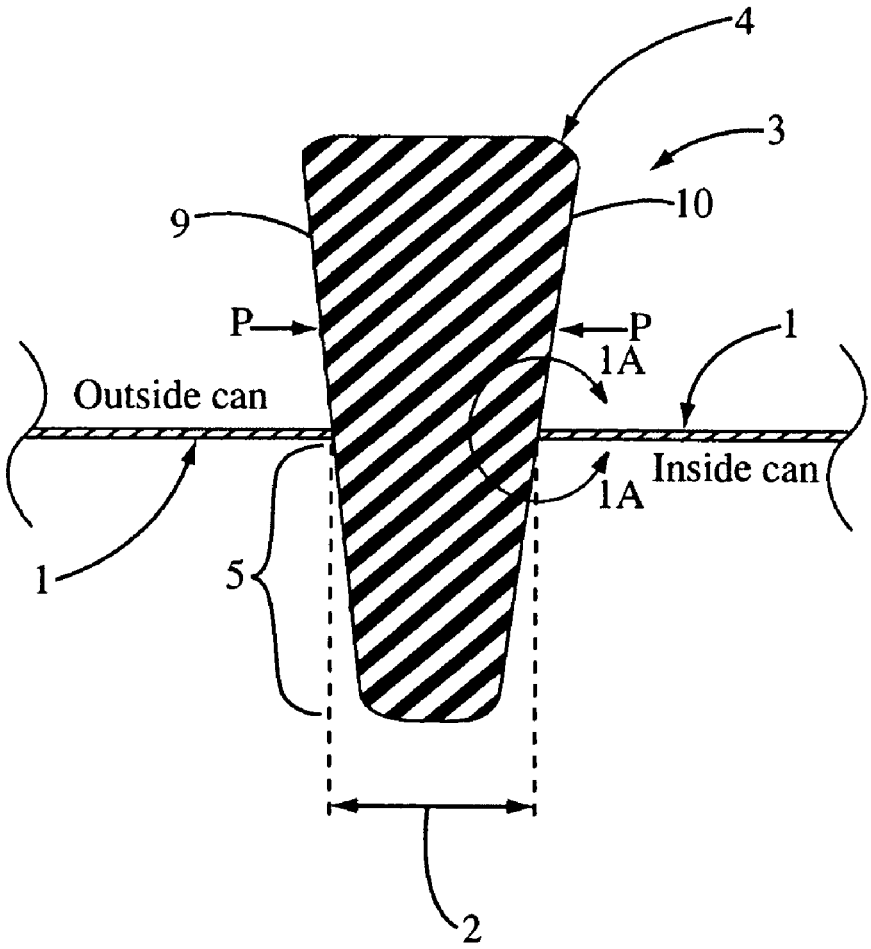
FIG. 1 is a sectional view of aluminum can top opening with a first embodiment plug therein.
Figure 1A:
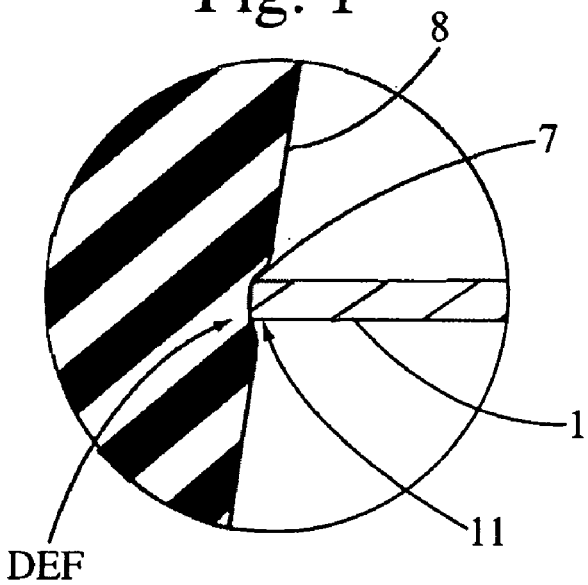
FIG. 1A is a close up view of the section 1A of FIG. 1.

Referring first to FIGS. 1, 1*a* an aluminum can lid 1 has a hole 2 which is temporarily sealed by a solid plug 3. The plug 3 has tapered sides 9, 10 such that forcing the base 5 of the plug 3 through the hole 2 engages the edges 7 of the hole against the peripheral edge 8 of the plug 3. The sealing area 11 consists of the hole edge 7 indenting the peripheral edge 8 of the plug all along the shape of the hole, wherein the typical shape is a teardrop, but could also be of any other shape.

The head/grip 4 of the plug 3 provides a grip for the user. Circle 1A designates a close up view shown in FIG. 1A. What is depicted is a temporary sealing plug shaped in conformity with the opened pouring hole in the lid of an aluminum beverage can. The plug body is non-toxic, solid and flexible such as soft rubber or soft plastic so as to form a sealing area along its sides when the can hole edge impinges the plug sides. The plug sides are tapered to allow the plug to be forced into the can hole, leaving a base 5 of the plug inserted into the can interior. The hole edge 7 slightly deforms the peripheral edge 8 as shown by arrow DEF.

Figure 2:
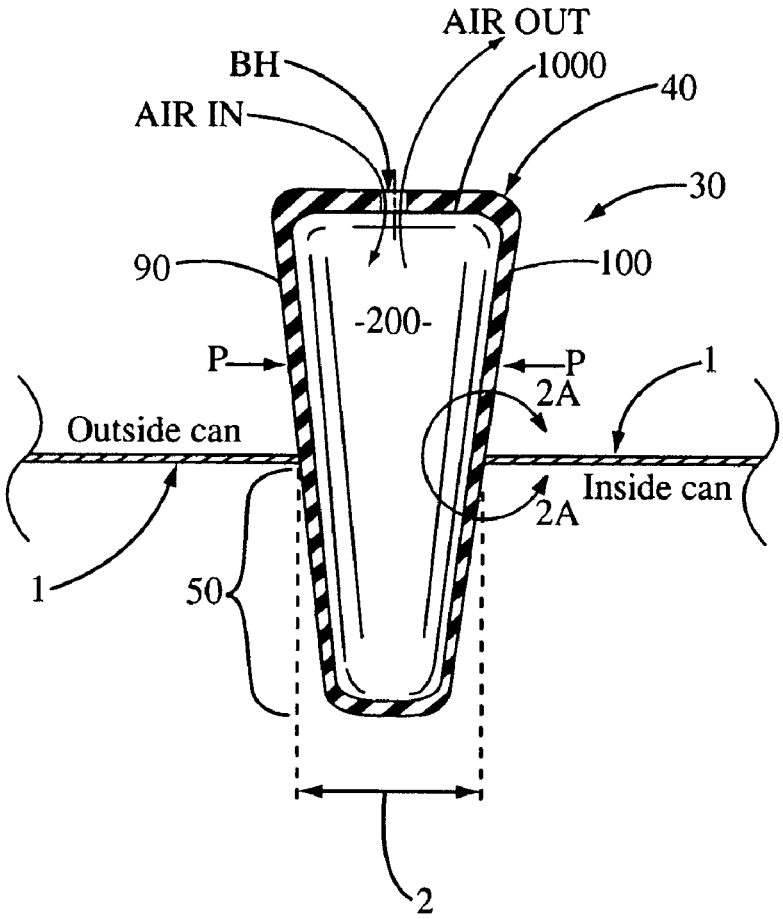
FIG. 2 is the same view as FIG. 1 with the second embodiment plug therein.
Figure 2A:
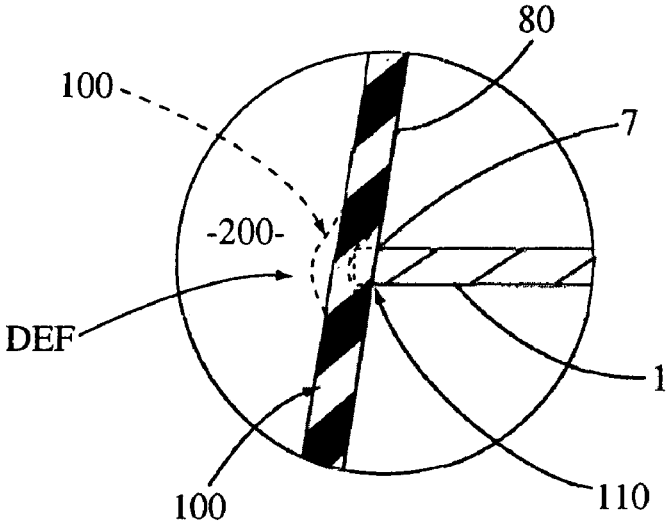
FIG. 2A is a close up view of section 2A of FIG. 2.

Referring next to FIGS. 2, 2A a plug 30 has the same external wedge shape as plug 3 of FIG. 1. Breathing hole BH allows airflow into and out of the hollow 200. However, the entire peripheral structure 1000 consists of a thin, flexible membrane such as a non-toxic soft rubber or a non-toxic soft plastic. The membrane 1000 creates an interior hollow space 200. Sides 90, 100 are tapered so that base 50 can be forced through hole 2. The exterior skin 80 is indented by hole edge 7 and sides 90 and 100 are deformed by the hole edge 7 as shown by dotted lines DEF (deformed). Thus, a sealing area 110 is formed.

Figure 3:
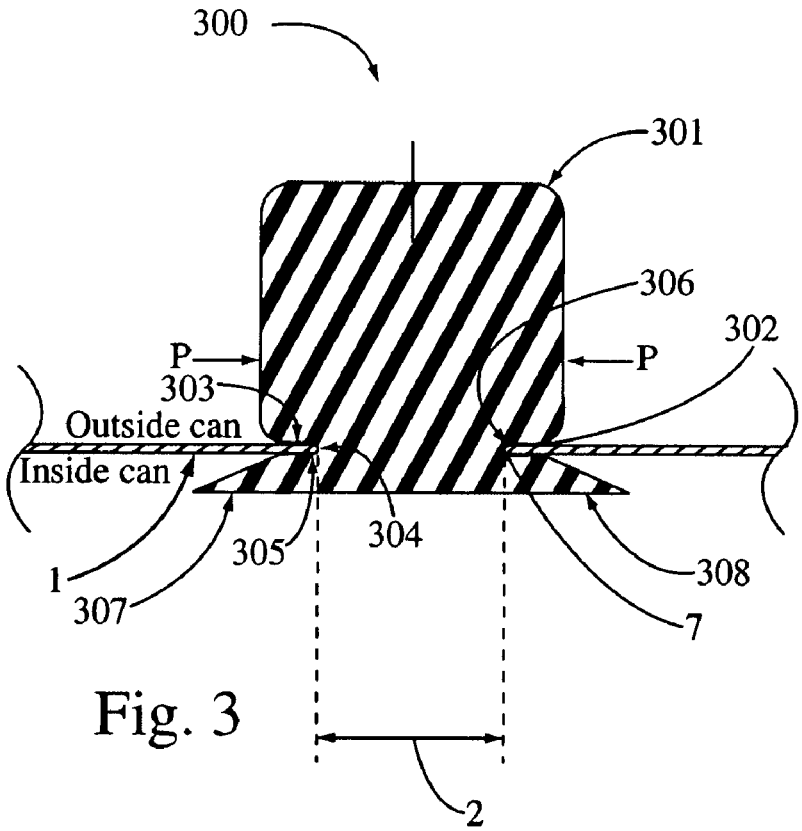
FIG. 3 is the same view as FIG. 1 with the third embodiment plug therein.

Referring next to FIG. 3 a foot (shoulder) profile style plug 300 is preferably made of a solid non-toxic soft rubber or soft plastic. Once again the plug top view shape conforms to the contour of hole 2 (usually a teardrop or other shaped hole). The head/grip 301 provides a grip for the user. The indentation (neck) 306 receives the hole edge 7 as the user forces the foot 307 and 308 through the hole 2. Shoulders 307 and 308 are also tapered in order to help insertion into the hole 2 to fit the hole edge 7 into the neck 306. Shoulders 307, 308 extend beyond the dimensions of the hole edges 7, as does the dimensions of the head/grip 301. There is formed a neck with triple sealing area 302. It consists of indentation top surface 303, indentation inner surface 304, and indentation bottom surface 305 all contacting hole edge 7 and the can lid's outer and inner surfaces around the hole.

Figure 4:
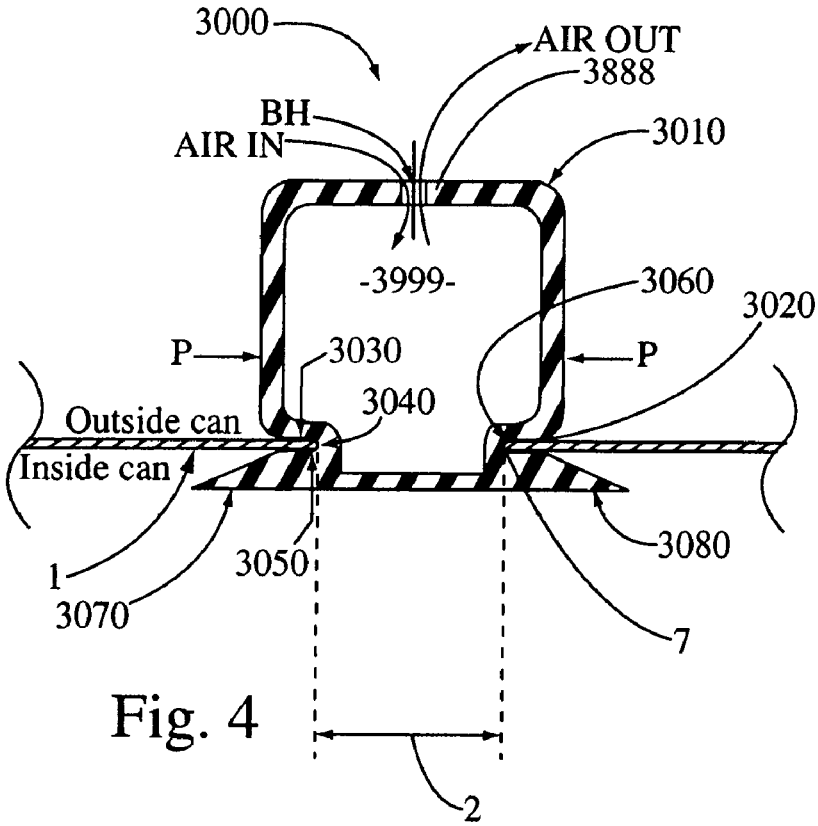
FIG. 4 is the same view as FIG. 1 with the fourth embodiment plug therein.

Referring next to FIG. 4 a hollow plug 3000 has an exterior profile shape like plug 300 of FIG. 3. A flexible membrane 3888 creates a hollow space 3999. A breathing hole BH allows air flow into and out of hollow space 3999. The head/grip 3010 provides a grip for the user. The user forces the foot (shoulder) 3070 and 3080 through the hole 2. The indentation (neck) 3060 forms a triple sealing area 3020. The indentation top surface 3030, the indentation inner surface 3040 and the indentation bottom surface 3050 all contact hole edge 7 and can lid outer and inner surfaces around the hole. The shoulders 3070 and 3080, which are also tapered in order to help insertion into the hole 2 and fitting the edge of the hole 7 into the neck 3060, extend beyond the dimension of hole 2 as does the head/grip 3010.

Figure 5:
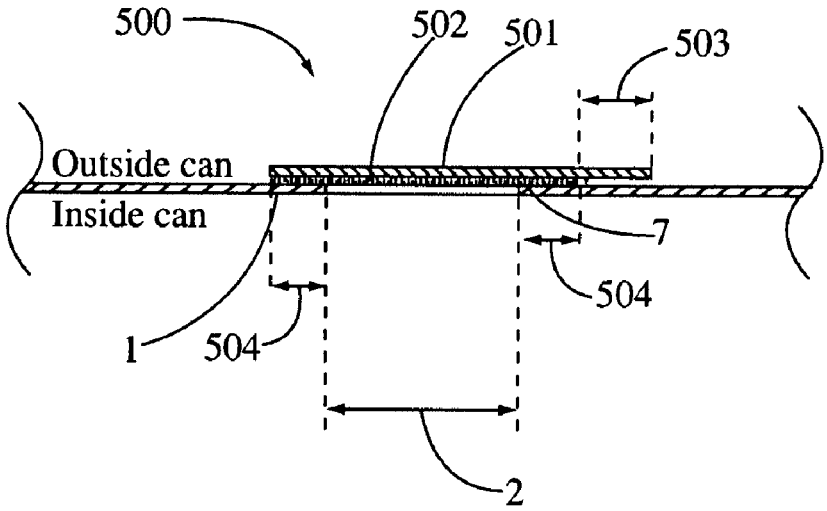
FIG. 5 is a sectional view of an aluminum can top opening with a re-sealable tape type tab, the fifth embodiment.

Referring next to FIG. 5 the tape/foil style-sealing and reopening device 500 could either be a re-sealer as the plugs in FIGS. 1-4 or also a primary sealing/opening and resealing device for a custom made can lid. The tape 501 could be made from aluminum foil, soft rubber, or soft plastic or cellophane (all non-toxic). It extends beyond the dimensions of hole 2. The non-toxic glue layer 502 also extends beyond the dimensions of hole 2. A tab (tongue) 503 does not have any glue. The sealing area 504 consists of the two layers 501, 502 covering a chosen distance beyond the edge 7 of hole 2.

Figure 6:
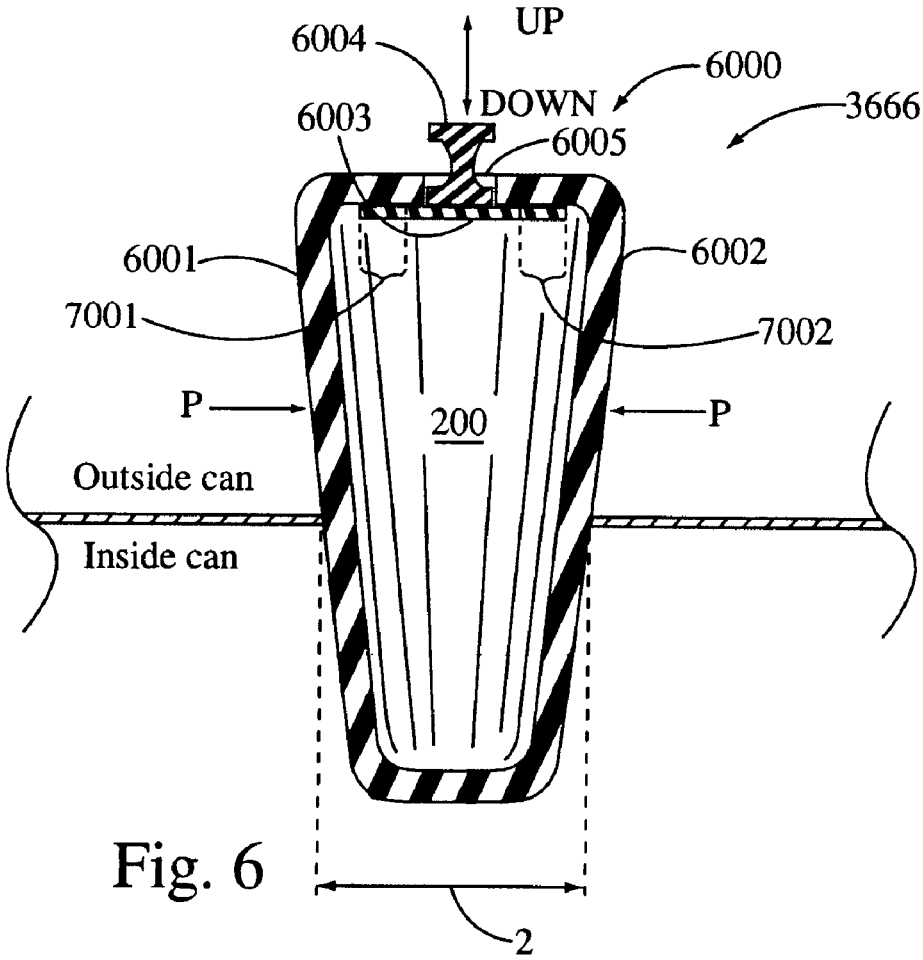
FIG. 6 is the same view as FIG. 2 with a simple "hold and release" double-acting air-valve wedge plug, embodiment number six.

Referring next to FIG. 6 the pump version-sealing device 3666 is the same as plug 30 of FIG. 2 with the addition of a simple hold and release double acting air valve 6000 consisting of membrane 6003 and button 6004. The plug 3666 consists of squeezable sides 6001, 6002, squeezed at points P to deform sides 6001,6002 to insert plug 3666 into hole 2 and pump air into the hollow 200.

Figure 7:
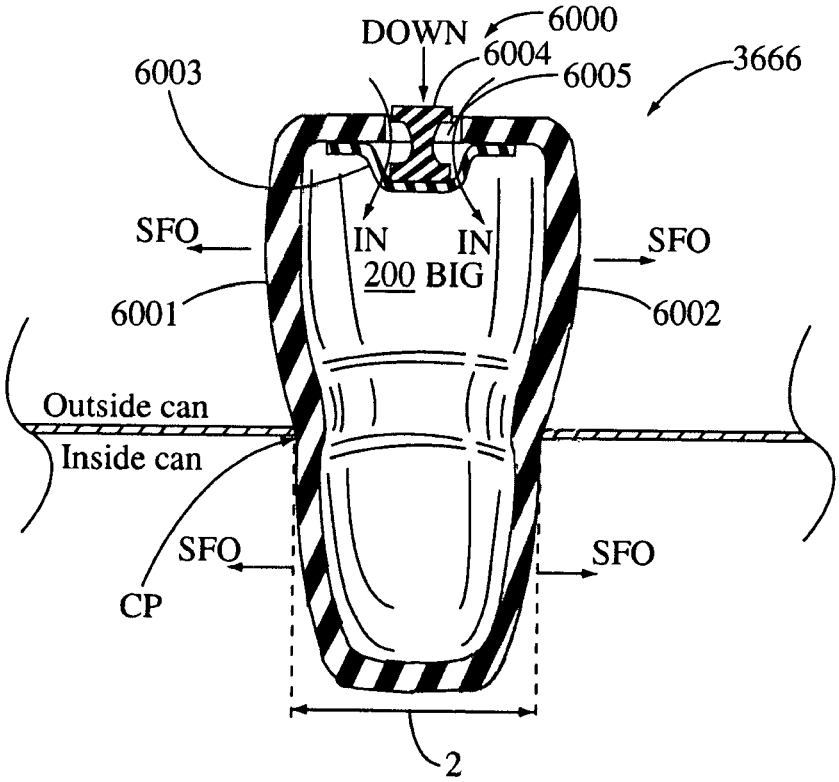
FIG. 7 is the same view as FIG. 6 with a simple "hold and release" double-acting air-valve with air pumped into the hollow space.

Referring next to FIG. 7 the user has released points P, thereby causing a momentary spring force outbound SFO which is caused by the resilience of sides 6001, 6002. This creates a temporary increase in the volume of hollow space 200, designated as 200BIG. The increased volume 200BIG creates a temporary vacuum which allows the ambient air to overcome the resilience of flap 6003, thereby forcing a small amount of air through valve port 6005 shown by arrows in, FIG. 7.

Figure 8:
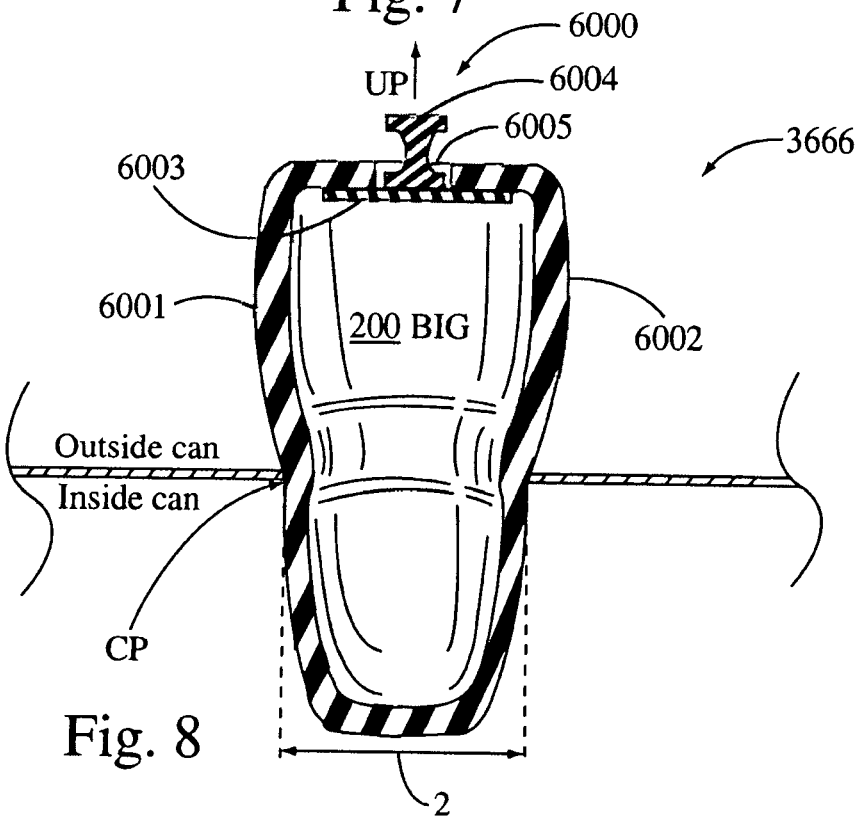
FIG. 8 is the same view as FIG. 7 with the plug pumped tight and in place in the hole in the can lid.

Once the air has entered hollow 200, creating volume 200BIG, then the air is trapped in volume 200BIG via flap 6003 as shown in FIG. 8. Thus, flap 6003 acts like a one-way valve, only allowing air into volume 200. FIG. 8 shows the closed/sealed mode of plug 3666. The sides 6001, 6002 have expanded outbound due to increased volume 200BIG and the slight pressure increase of volume 200BIG compared to ambient pressure. The sides 6001, 6002 have pressed against the periphery of hole 2 at CP, thus creating a pressurized seal for hole 2 which can help keep gasses in the can's beverage from escaping. This improved maintenance of the beverage's gasses in the beverage helps prevent the beverage from tasting flat.

Figure 9:
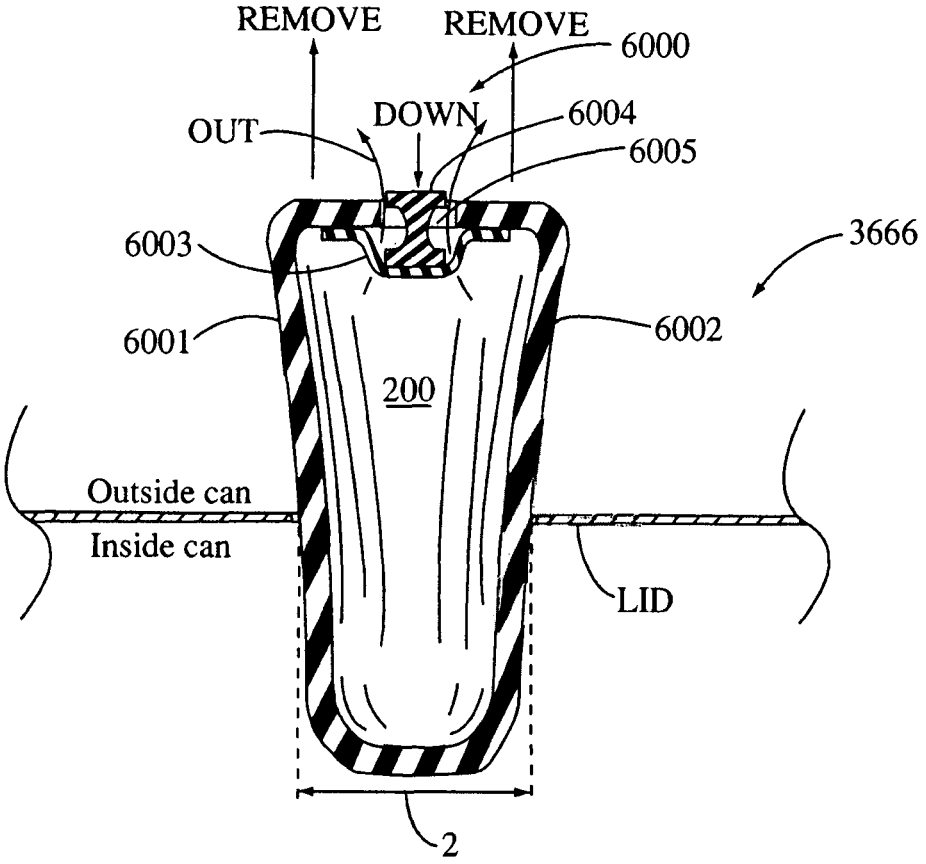
FIG. 9 is the same view as FIG. 8 with the air in the plug being removed for extracting the plug out of the hole in the can lid.

In FIG. 9 the user is removing plug 3666 in direction REMOVE. He has pressed button 6004 in direction DOWN, thereby pushing flap 6003 away from its sealing engagement over valve port 6005, air has escaped from port 6005 as shown by arrows out. Volume 200BIG has reduced back to equilibrium volume 200. The plug 3666 can now be removed in direction REMOVE.

Figure 10:
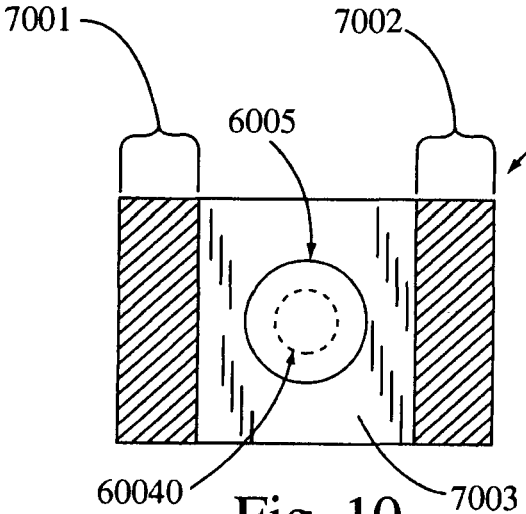
FIG. 10 is a top plan view of the double acting air valve of FIGS. 6 and 12.
Figure 11:
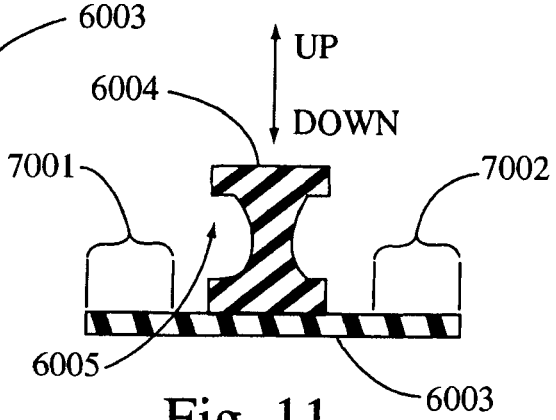
FIG. 11 is a side plan view of the FIG. 10 double acting air valve.

FIGS. 10, 11 show the elements of valve 6000. The button 6004 is moveable in directions UP, DOWN to force membrane (flap) 6003 away from port 6005. Membrane or flap 6003 is attached to the inside top of the plug 3666 at ends 7001, 7002. Thus, only flap portion 7003 can move up and down to close and open port 6005. Area 60040 attaches (preferably glued) the bottom of button 6004 to flap 6003.

Figure 12:
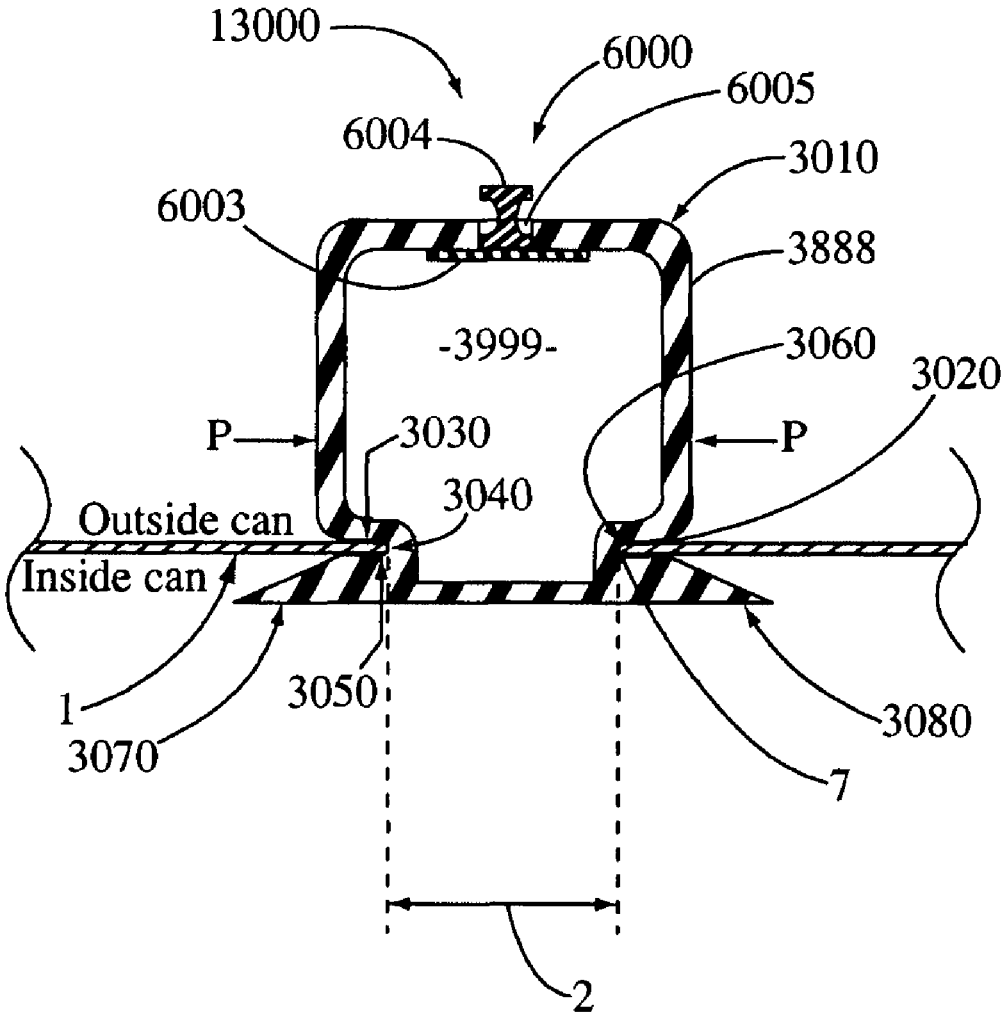
FIG. 12 is the same as FIG. 4 with a simple "hold and release" double acting air valve, a profile plug, and which works in the same manner as described in FIGS. 7,8, 9, this is embodiment number 7.

Referring next to FIG. 12 a hollow plug 13000 is similar to plug 3000 of FIG. 4 except the simple hold and release double acting air valve 6000 from FIG. 6 has been added. The operation of valve 6000 is the same as described for FIGS. 6, 7, 8, 9, 10, 11.

Although the present invention has been described with reference to the disclosed embodiments, numerous modifications and variations can be made and still the result will come within the scope of the invention. No limitation with respect to the specific embodiments disclosed herein is intended or should be inferred. Each apparatus embodiment described herein has numerous equivalents.

We claim:

1. A resealing device for a container having an aluminum top with a tab opening mechanism engaging a scored flap in said top for forming a contents dispensing aperture, when the scored flap is removed, the resealing device comprising:

a hollow plug made of a non-toxic, flexible material;

said plug having a thin, flexible wall membrane defining a hollow wedge shaped plug with a top, a bottom and sides forming a hollow in an interior chamber;

said interior chamber having a wedge shape;

said plug having a midsection shaped to conform to a shape of the contents dispensing aperture;

said plug having tapered outer sides and the top having a breathing hole communicating with the hollow in the interior chamber;

wherein an upper portion of the plug above the midsection forms a user grip;

wherein a forcing of the plug by the user places a base of the plug below the contents dispensing aperture, thereby forming a seal comprising an indentation of the flexible wall membrane all along a periphery of the contents dispensing aperture;

wherein the breathing hole allows airflow out of the interior chamber of the hollow when the user grip is squeezed by a user; and wherein after a release of the user grip by the user, air fills the hollow of the interior chamber via the breathing hole as the flexible material springs back to its original wedge shape, creating a reinforced seal so that a beverage in the container retains its carbon dioxide gas longer, thus preventing the beverage from tasting flat.

2. The plug of claim 1, wherein the periphery of the contents dispensing aperture has a teardrop shape.

3. The plug of claim 1, wherein the breathing hole further comprises a membrane attached across the breathing hole on the top inside of the interior chamber, a button contacting the membrane and projecting up through the breathing hole so as to provide a push button for the user, and wherein a release of the user grip causes a momentary spring force inbound of the flexible membrane, thus allowing ambient air to enter the breathing hole and enter into the interior chamber, thereby forming a pressurized seal of the flexible wall membrane all along the periphery of the contents dispensing aperture, and wherein the user can push down on the push button to push the membrane away from the breathing hole, thus allowing air to escape from the interior chamber, thereby facilitating a removal of the plug from the contents dispensing hole.

* * * * *